United States Patent [19]

Adams et al.

[11] Patent Number: 4,640,695

[45] Date of Patent: Feb. 3, 1987

[54] SEGMENTED ELECTRODE COLLECTING PANEL ASSEMBLY

[75] Inventors: James H. Adams, Pleasant Grove; Jerry L. Burgess, Birmingham; William C. Wagers, Alabaster, all of Ala.

[73] Assignee: Combustion Engineering, Inc., Windsor, Conn.

[21] Appl. No.: 842,598

[22] Filed: Mar. 21, 1986

[51] Int. Cl.[4] ..... B03C 3/47

[52] U.S. Cl. ..... 55/130; 55/143; 55/145; 55/148; 55/156

[58] Field of Search ..... 55/130, 148, 156, 154, 55/145, 143, 141

[56] References Cited

U.S. PATENT DOCUMENTS

| | | | |
|---|---|---|---|
| 1,912,053 | 5/1933 | Wintermute | 55/130 |
| 3,530,645 | 9/1970 | DeLisio | 55/148 X |
| 3,660,968 | 5/1972 | Dyla et al. | 55/130 |
| 4,240,810 | 12/1980 | Frauenfelder | 55/143 |

*Primary Examiner*—Kathleen J. Prunner
*Attorney, Agent, or Firm*—William W. Habelt

[57] ABSTRACT

A collecting electrode panel assembly comprises a plurality of collecting electrode plates disposed in successively aligned relationship beneath and suspended from an electrode support member supported by the housing of an electrostatic precipitator, such that the collecting electrode plates making up the collecting electrode panel assembly extend downwardly in a substantially vertical plane into the precipitation chamber defined within the housing. Each of the plates has a pair of spaced end members and a central web portion which extends between and interconnects the spaced end members. Each end member has an edge surface extending substantially transverse to the central web portion thereof. A plurality of suspension lugs are mounted to the electrode support member and are disposed therealong such that a suspension lug extends outwardly therefrom adjacent each of the end members of the plates. A fastener is provided for mounting each end member to one of the suspension lugs. The dimension of each lug is such that no portion of a lug extends beyond the lateral extremities of the edge surface of the end member.

5 Claims, 4 Drawing Figures

SEGMENTED ELECTRODE COLLECTING PANEL ASSEMBLY

BACKGROUND OF THE INVENTION

The present invention relates to electrostatic precipitators and, more particularly, to segmented collecting electrode panels comprised of a plurality of individual collecting electrode plates suspended from a support beam.

In the operation of an electrostatic precipitator, a gas laden with entrained particulate material will pass through an electrostatic field established about a discharge electrode assembly disposed intermediate to grounded collecting electrode panels. The suspended particles become electrically charged as they pass through the electrostatic field and move to, under the influence of the electrostatic field, and deposit upon the grounded collecting electrode panels flanking the discharge electrode assembly.

Although the prior art includes various collecting electrode panel designs, collecting electrode panels are commonly constructed in modular form by suspending a plurality of successively aligned collecting electrode plates in end to end relationship to form the collecting electrode panel. Each collecting electrode plate is typically suspended from a support beam mounted in the top of the precipitator housing to extend downwardly in a vertical plane. Each individual plate is formed of sheet metal and typically ranges from 1 to 3 feet in width and typically from 30 to 50 feet in length. One common configuration of collecting electrode plate is shown in U.S. Pat. No. 4,240,810. As disclosed therein, each panel includes a central flat plate web portion extending between spaced end portions which comprise J-shaped stiffening beams.

It has been common practice in the prior art to suspend the collecting electrode plates from the support beam by means of fasteners, such as pins or bolts, which extend transversely through the collecting electrode plates into the support beam or into a support lug mounted to the support beam. In either case, the ends of the fasteners would extend perpendicularly outwardly beyond the extremities of the collecting electrode plates. As a minimum distance must be maintained between the discharge electrode assembly and the nearest point of the collecting electrode assembly, the extension of the fastener means beyond the extremity of the plane of the collecting electrode plate results in a spacing between the collecting electrode assembly and the discharge electrode assembly being set such that the end of the fastener means is beyond the minimum distance. Therefore, the spacing that actually exists between the collecting electrode panel and the discharge electrode assembly is greater than that required to prevent electrical spark-over between the electrodes themselves in order to avoid electrical spark-over between the discharged electrode and the ends of the fastener means utilized to link the collecting electrode plates to the support beam. Thus, the precipitator housing is, in effect, oversized in order to accommodate the necessary increase in spacing in order to prevent spark-over between the discharge electrodes and the ends of the fastener means.

SUMMARY OF THE INVENTION

It is the object of the present invention to provide a collecting electrode panel assembly wherein the individual collecting electrode plates are suspended from the support beam by means which do not extend beyond the extremities of the collecting electrode plates, thereby reducing the actual spacing required to be maintained between the collecting electrode assembly and the discharge electrode assembly in order to prevent electrical spark-over.

The collecting electrode panel assembly of the present invention comprises a plurality of collecting electrode plates disposed in successively aligned relationship beneath and suspended from an electrode support member adapted to be supported by the housing of an electrostatic precipitator, such that the collecting electrode plates making up the collecting electrode panel extend downwardly in a substantially vertical plane into the precipitation chamber defined within the housing. Each of the collecting electrode plates has a pair of spaced end members and a central web portion which extends between and interconnects the spaced end members. Each end member of the collecting electrode plates has an edge surface extending substantially transverse to the central web portion thereof.

Suspension means operatively associated with each collecting electrode plate are provided for suspending the collecting electrode plates from the electrode support member. The suspension means comprises a plurality of suspension lugs mounted to the electrode support plate and disposed therealong such that a suspension lug extends outwardly therefrom adjacent each of the end members of the collecting electrode plates forming the collecting electrode panel. Fastener means are provided for mounting each end member of a collecting electrode plate to one of the suspension lugs. The fastener means have a longitudinal axis disposed substantially transverse to the edge surface of the end member such that the fastener means does not extend beyond the lateral extremities of the edge surface of each end member. The dimension of each suspension lug is such that no portion of a suspension lug extends beyond the lateral extremities of the edge surface of the end member.

BRIEF DESCRIPTION OF THE DRAWING

The present invention will be better understood and the above and other objects of the present invention will become more apparent and appreciated when you viewed in light of the following description of a preferred embodiment with reference to the accompanying drawings, wherein.

DESCRIPTION OF THE PREFERRED EMBODIMENT

Figure 1:
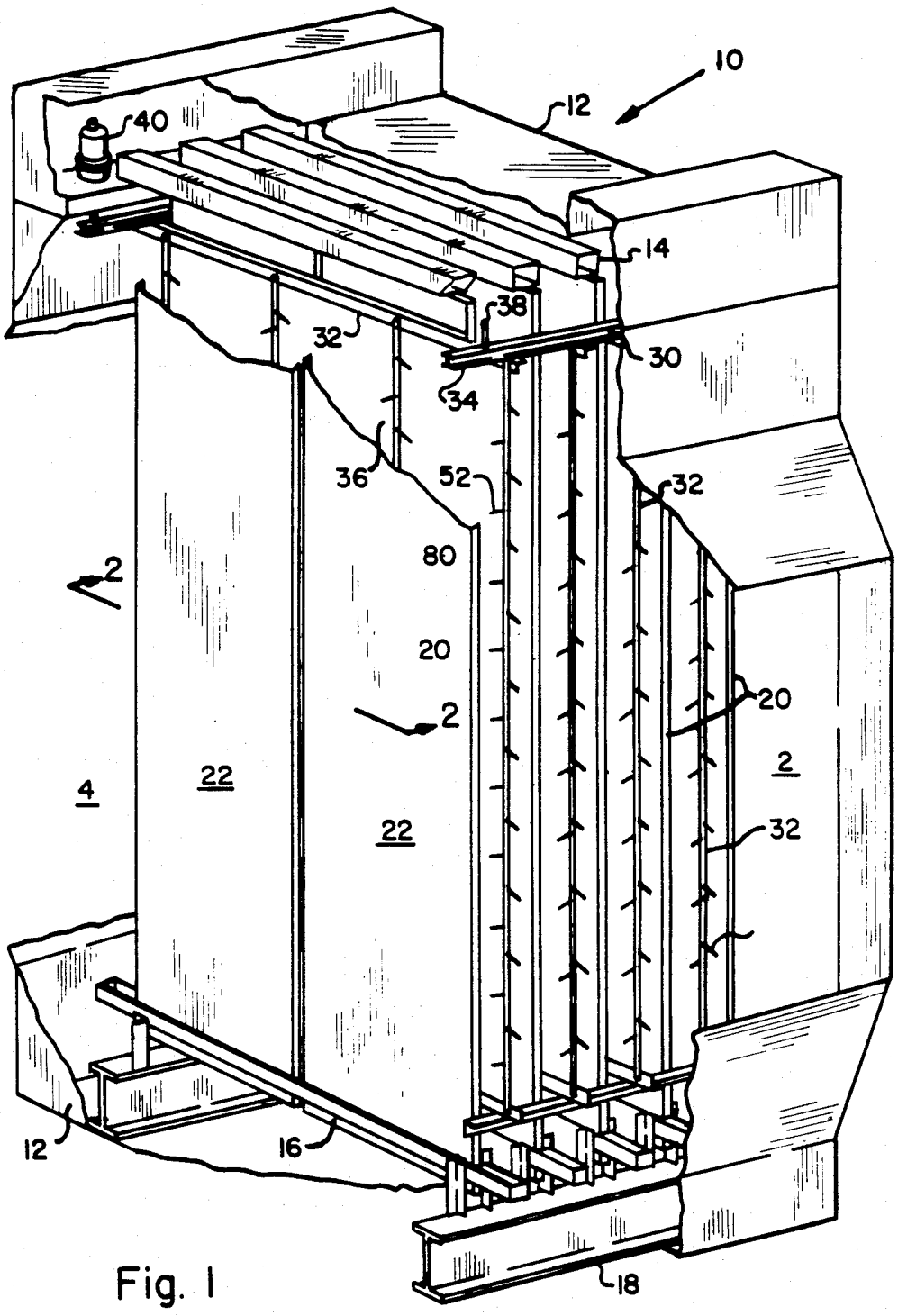
FIG. 1 is a perspective view, partly in section, of an electrostatic precipitator incorporating the collecting electrode panel assembly of the present invention.
Figure 2:
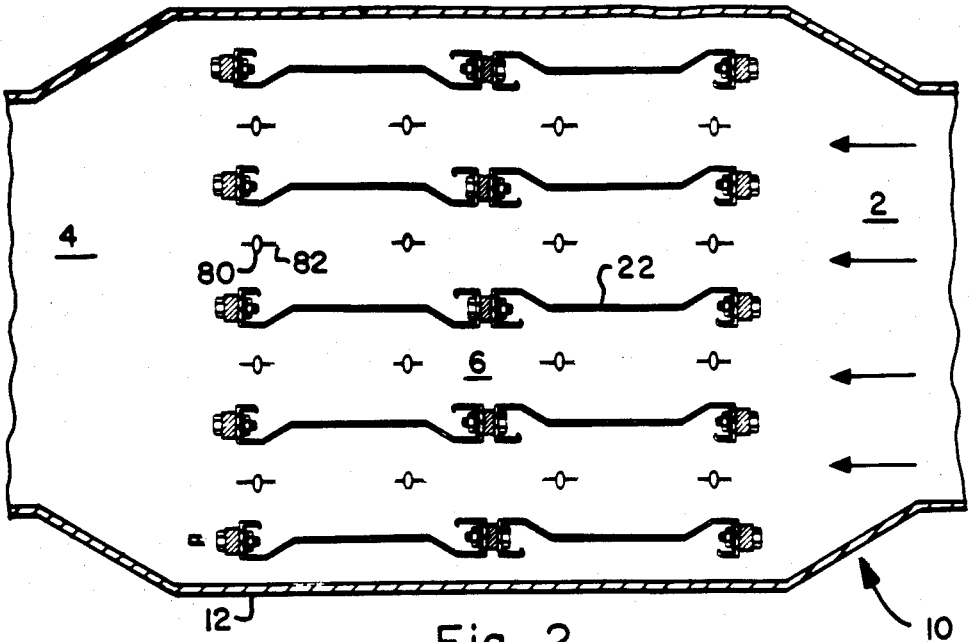
FIG. 2 is a sectional plan view taken along line 2—2 of FIG. 1.

Referring now to the drawing, and most particularly, to FIGS. 1 and 2 thereof, there is depicted therein an electrostatic precipitator 10 having a casing 12 with an inlet 2 and outlet 4 and precipitation chamber 6 disposed therebetween. The particulate laden flue gas to be cleaned passes through the housing 12 of the precipitator 10 passing from the gas inlet 2 through the precipitation chamber 6 and out the gas outlet 4 as clean, relatively particulate free gas.

A plurality of collecting electrode panels 20 are disposed in substantially parallel, spaced relationship in vertical planes within the precipitation chamber 6. Interdisposed in the spaces between the collecting electrode panels 20 are a plurality of discharge electrode subassemblies 32, which collectively form a discharge electrode assembly 30. Both the collecting panels 20 and the discharge electrode subassemblies 32 are aligned parallel to and extend in the direction of gas flow through the precipitation chamber 6 from the inlet 2 to the outlet 4 thereof.

Each of the individual discharge electrode subassemblies 32 is formed of a plurality of individual tubular discharge electrodes 80 disposed at spaced intervals to extend transversely between and be mounted to an upper frame member and a lower frame member of the subassemblies. The individual discharge electrode subassemblies are suspended from a support bar 34, which extends across the top of the precipitation chamber 6 and is mounted to the casing 12 through insulators 40. The individual discharge electrodes 80 are shown as tubular discharge electrodes having a plurality of corona discharge pins 82 extending outwardly from the tubular portion of the discharge electrode.

The discharge electrodes are shown in the drawing as being of this particular design, merely for purposes of illustration and not limitation. It is to be understood that the present invention contemplates utilizing any of a number of discharge electrode designs known in the art. For example, the discharge electrodes 80 could consist of a plurality of wires or rods, with or without corona discharge points disposed along their length. If the discharge electrodes are of tubular design, the tubular members could have a circular or elliptical cross-section or any other appropriate cross-section which would yield the desired electrostatic field configuration.

In operation, a particulate laden gas enters the precipitator casing 12 through the inlet 2 thereof and flows through the precipitation chamber 6 to the outlet 4 thereof. In traversing the precipitation chamber 6, the particulate laden gas flows between the spaced collecting electrode panels 20 and over the discharge electrode subassemblies 32 suspended therebetween. An electrical charge is applied to each of the discharge electrode subassemblies 32, so as to establish an electrostatic field extending between the discharge electrodes 80 and the grounded collecting electrode panels 20. As the particulates within the gas pass through the precipitation chamber 6, the particles are ionized and migrate to and deposit upon the collecting electrode plates 22 forming the grounded collecting electrode panel 20.

Figure 4:
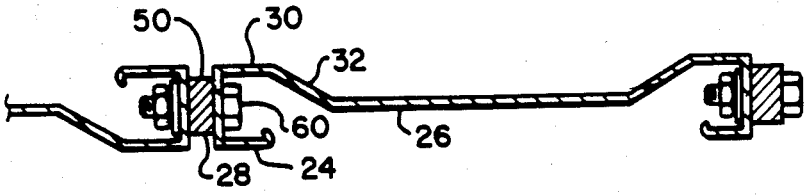
FIG. 4 is a sectional view taken along line 4—4 of FIG. 3.

Each collecting electrode panel 20 is formed of a plurality of collecting electrode plates 22, which are disposed in successively aligned relationship beneath and suspended from an electrode support member or beam 14, which extends across the top of the precipitation chamber 6 and is adapted to be supported by the housing 12 of the precipitator 10. Each of the collecting electrode plates 22 is comprised of a pair of spaced end members 24 and a central web portion 26, extending between and interconnecting the spaced end members 24. Each end member 24 has an edge surface 28 extending substantially transverse into the central web portion 26 of the collecting electrode plate. In the preferred embodiment of the present invention as best seen in FIG. 4, each end member 24 of each of the collecting electrode plates 22 comprises an elongated beam of hook-shaped cross-section having a base portion 30 having an edge surface 28 and a stem portion 32 extending from the base portion 30 to connect to the central web portion 26 of the collecting electrode plate.

Figure 3:
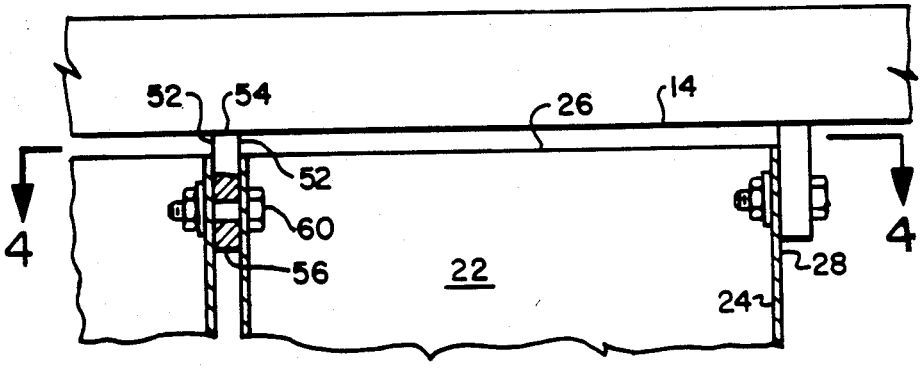
FIG. 3 is an enlarged detailed view illustrating the suspension of collecting electrode plates suspended from a support beam in accordance with the present invention.

To suspend the collecting electrode plates 22 from the electrode support member 14 extending across the top of the precipitation chamber 6, a plurality of suspension means 50 are provided in operative association with each of the collecting electrode plates 22. In accordance with the present invention, the suspension means 50 comprises a plurality of suspension lugs mounted to the electrode support member 14 and disposed therealong at spaced intervals such that a suspension lug 50 extends outwardly from the electrode support member 14 adjacent each of the end members 24 of the collecting electrode plates 22 as best seen in FIGS. 3 and 4. Fastener means 60, for example a bolt, a washer and a nut, are provided for mounting each of the end members 24 of the collecting electrode plates 22 to one of the suspension lugs 50.

Each fastener means 60 is disposed with its longitudinal axis substantially transverse to the edge face 28 of the end member 24, such that the fastener means 60 does not extend beyond the lateral extremities of the edge surface 28 of the end member 24 of each collecting electrode plate 22. Additionally, each suspension lug 50 is disposed so as to abut the edge surface 28 of the end member or end members mounted to it and dimensioned such that the lateral surfaces 52 of the suspension lug do not extend beyond the lateral extremities of the edge surface 28 of the end members 24 of the collecting electrode plates 22. As the fastener means 60 and the suspension lug 50 are disposed so that no portion or portions thereof extend beyond the lateral extremities of the edge surface 28 of the end member 24, there will be no portion of the fastener means or suspension means which extend beyond the outer most surface of the collecting electrode plates 22. Therefore, unlike the prior art where the collecting electrode panels must be spaced beyond the minimum distance required to preclude electrical spark-over as discussed hereinbefore, the collecting electrode panels 20 constructed in accordance with the present invention may be spaced from the discharge electrode assembly at the minimum distance required to preclude electrical spark-over and, therefore, be closer to the discharge electrode assemblies than permitted in the prior art thereby reducing the overall width of the precipitator housing 12.

In the preferred embodiment of the present invention, each suspension lug 50 comprises a flat plate-like tab having a base portion 54 mounted to the electrode support member 14, typically by welding, and an extended portion 56 extending outwardly from the base edge 54 of the tab such that at least one lateral surface 52 of the extended portion 56 of the tab abuts the edge surface 28 of the end member 24 of at least one collecting electrode plate 22. When a suspension lug 50 is disposed at the junction of two adjacent collecting electrode plates 22 of the plurality of successively aligned collecting electrode plates, the extended portion 56 of the suspension tab 50 extends outwardly from the base edge 54 thereof between the edge surfaces 28 of the end members 24 of the adjacent collecting electrode plates 22 as best seen in FIGS. 3 and 4. One lateral surface 52 of the extended portion 56 of the tab 50 abuts the edge surface 28 of the end member 24 of one of the adjacent collecting electrode plates 22, while the other lateral surface 52 of the extended portion 56 of the tab 50 abuts the edge surface 28 of the end member 24 of the other of the adjacent collecting electrode plates 22. The extended portion 56 of the tab 50 is provided with a hole therein through which the fastener means 60 passes, whereby the end members 24 of the two adjacent collecting electrode plates 22 may be securably mounted to the tab 50 for suspension from the electrode support member 14.

As shown in the drawing, the fastener means 60 are disposed completely within the hook-shaped beam end portion 30 of each collecting electrode plate 22. The edge surface 28 of the base of the hook-shaped beam portion 30 of the end member 24 abuts the lateral edge 52 of the extended portion 56 of the suspension lug 50 and is secured thereto by the fastener means 60. The fastener means 60 is disposed within the hook-shaped portion 30 of the end member 24, preferably with the longitudinal axis of the fastener means 60 aligned with the plane of the central web portion 26 of the collecting electrode plate 22 which is mounted to the suspension lug 50. In this manner, the fastener means is disposed within the hook-shaped portion 30 of the end member 24, such that the fastener means 60 is shielded by the lateral surfaces of the hook-shaped portion 30 from the electrostatic field generated by the discharge electrode assembly.

Although described and illustrated herein with reference to the preferred embodiment shown in the drawings which represents the best mode presently contemplated for carrying out the present invention, it is to be understood that many variations of the depicted embodiment may be envisioned by those skilled in the art without departing from the basic concept of the present invention. For example, the configuration of the collecting electrode plate may not be that embodying the hook-shaped end member illustrated in the drawings. The collecting electrode plate may be of any configuration wherein there is a central web portion interconnecting two spaced end surfaces which extend transversely to the central web portion. For instance, the collecting electrode plate may have the configuration of an I-beam having a flat plate central web extending between two flat end surfaces disposed transverse to the central web.

Additionally, the suspension lug of the present invention may take on other forms than that of a flat-plate tab. For example, the suspension lug could be comprised of a substantially U-shaped member having a base portion welded or otherwise mounted to the electrode support member and a pair of spaced lateral tabs extending outwardly from the base thereof between the edge surfaces of the end members of adjacent collecting electrode plates such that the lateral surface of each tab abuts the edge surface of the end member of one of the collecting electrode plates and would be mounted thereto by suitable fastener means. Accordingly, it is intended that the present invention be interrupted in spirit and in scope as defined by the claims appended hereto.

We claim:

1. A collecting electrode panel assembly for mounting within a precipitation chamber housing of an electrostatic precipitator, comprising:

a. an electrode support member adapted to be supported by the housing of the precipitator;

b. a plurality of collecting electrode plates disposed in successively aligned relationship beneath and suspended from said electrode support member, each of said collecting electrode plates having a pair of spaced end members and a central web portion extending between and interconnecting the spaced end members, each end member having an edge surface extending substantially transverse to the central web portion;

c. suspension means operatively associated with said collecting electrode plates for suspending said collecting electrode plates from said electrode support member, said suspension means comprising a plurality of suspension lugs mounted to said electrode support member and disposed therealong such that a suspension lug extends outwardly therefrom adjacent each of the end members of said collecting electrode plates; and d. fastener means for mounting each of the end members of said collecting electrode plates to one of said suspension lugs, said fastener means having a longitudinal axis disposed substantially transverse to the edge surface of the end member such that said fastener means does not extend beyond the lateral extremities of the edge surface of the end member.

2. A collecting electrode assembly as recited in claim 1 wherein each end member of each of said collecting electrode plates comprises an elongated beam of hooked-shaped cross-section having a base portion having an edge surface mounted to one of said support lugs and having a stem portion connected to the central web portion of said collecting electrode plate.

3. A collecting electrode assembly as recited in claim 2 wherein said fastener means are disposed so as to extend within the hooked-shaped beam end member of each collecting electrode plate.

4. A collecting electrode as recited in claim 1 wherein each suspension lug comprises a flat plate-like tab having a base edge mounted to said electrode support member and an extended portion extending outwardly from the base edge to abut the edge surface of the end member of at least one collecting electrode plate.

5. A collecting electrode as recited in claim 4 wherein each suspension tab disposed at the junction of adjacent collecting electrode plates of said plurality of successively aligned collecting electrode plates has an extended portion extending outwardly from the base edge therefrom between the edge surfaces of the end members of adjacent collecting electrode plates, the extended portion of the tab having lateral surfaces on opposite sides thereof, one lateral surface abutting the edge surface of the end member of one of the adjacent collecting electrode plates and the other lateral surface abutting the edge surface of the end member of the other of the adjacent collecting electrode plates, the extended portion of the tab having a hole therein through which said fastener means passes whereby the end members of the adjacent collecting electrode plates are securably mounted to the tab for suspension from said electrode support member.

* * * * *